United States Patent [19]

Gittins-Thomas

[11] 4,341,517

[45] Jul. 27, 1982

[54] CURING KILN

[76] Inventor: Mervyn Gittins-Thomas, 4, The Points, Cox-Green, Maidenhead, Berkshire, England

[21] Appl. No.: 195,067

[22] Filed: Oct. 7, 1980

[30] Foreign Application Priority Data

Aug. 19, 1980 [GB] United Kingdom ..... 8027032

[51] Int. Cl.[3] ..... F27B 9/16; F27D 3/12; F26B 25/00

[52] U.S. Cl. ..... 432/141; 34/239; 126/338

[58] Field of Search ..... 432/141; 34/239; 126/338; 211/95, 96

[56] References Cited

U.S. PATENT DOCUMENTS

| | | | |
|---|---|---|---|
| 126,086 | 1/1872 | Coburn | 432/141 |
| 1,248,877 | 11/1917 | Rabb | 432/138 |
| 1,933,203 | 10/1933 | Az well | 211/163 |
| 3,982,890 | 9/1976 | Lovell | 432/138 |
| 4,205,216 | 5/1980 | Douglas | 219/121 LC |

FOREIGN PATENT DOCUMENTS

| | | | |
|---|---|---|---|
| 2339695 | 8/1977 | France | 34/239 |

*Primary Examiner*—John J. Camby
*Attorney, Agent, or Firm*—Cushman, Darby & Cushman

[57] ABSTRACT

A kiln for curing or drying articles has a heated chamber having at least two wall sections which are formed by two vertical panesl which rotate as part of a roundabout device. This may have other panels which divide the roundabout into a desired number of sectors. Within each sector are article support means, so that the articles may be loaded outside the kiln and brought inside it by rotation of the roundabout. The panels seal the chamber at their edges so as to minimise heat loss.

1 Claim, 3 Drawing Figures

CURING KILN

BACKGROUND OF THE INVENTION

This invention relates to a kiln, particularly for curing paints, inks and the like. Nevertheless, kilns or ovens according to the invention may also be used for other purposes.

Curing kilns are normally required to operate at relatively high temperatures, and both for efficiency and for tolerable working conditions must be effectively heat insulated. It has been found convenient to make ovens, therefore, as tunnel kilns through which articles may be moved by conveyor. However, tunnel kilns are very expensive and very space consuming. For many applications this not justified, but the only real alternative has been a conventional oven with a door. This is very wasteful of heat; slow, because the oven takes time to heat up after each new load is inserted; and makes for unpleasant working conditions. For fabrics, often a hot iron has been used, which is very labour intensive.

SUMMARY OF THE INVENTION

Accordingly, the invention provides a kiln comprising a closed chamber which can be heated by heating means, wherein two wall sections of the chamber are formed by panels which extend radially from an upright axis, the panels being capable of swinging about the axis and of engaging sealingly at their edges with other walls of the chamber so as to close the latter to minimise heat loss, and wherein at least two sets of holding means for articles to be treated can be brought alternatively into the chamber by swinging the panels about the axis.

BRIEF DESCRIPTION OF THE DRAWINGS

The invention will now be described in greater detail by way of example, with reference to the drawings in which.

DESCRIPTION OF THE PREFERRED EMBODIMENT

Figure 1:
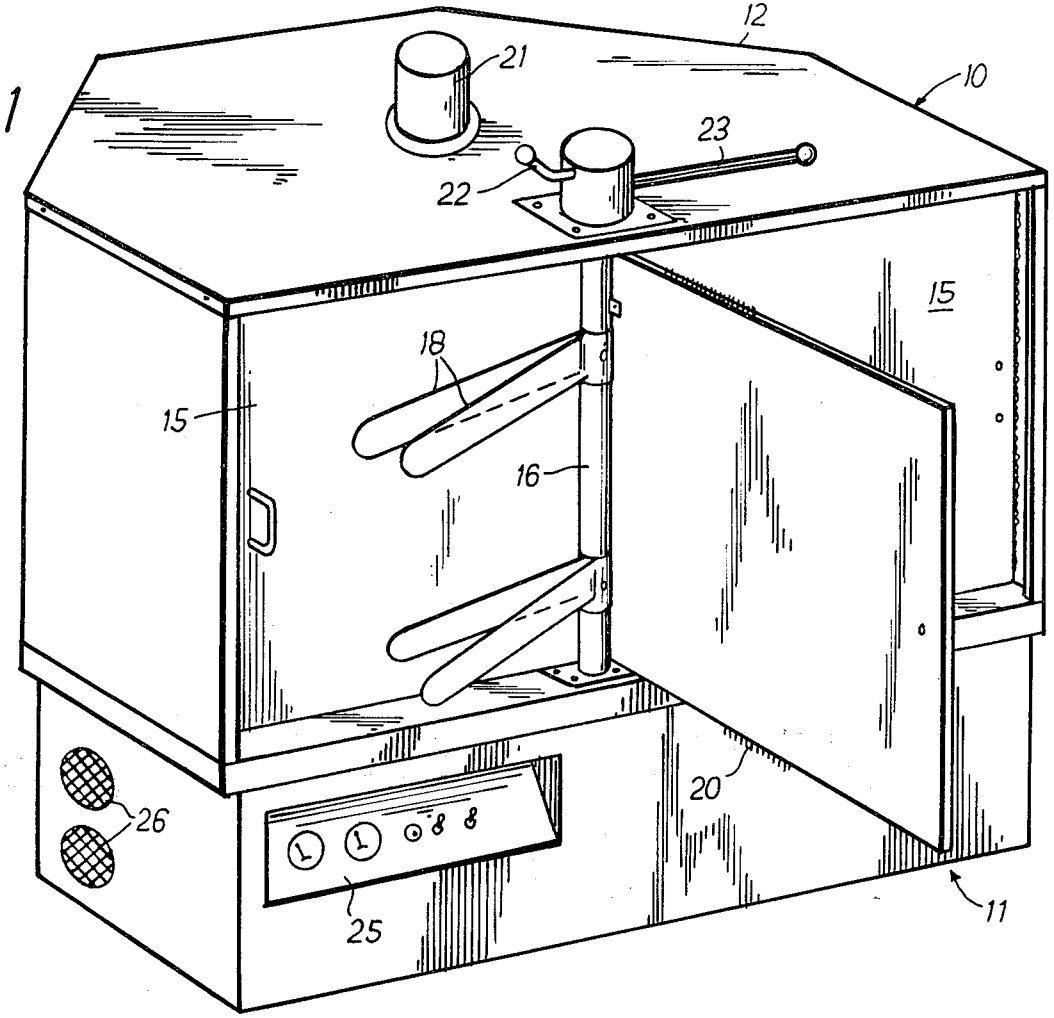
FIG. 1 shows a general perspective view of a kiln according to the invention.

The invention proposes a kiln having panels which extend radially from an upright axis. The panels are capable of swinging about the axis which brings holding means for articles to be treated into the kiln.

Preferably, there are four panels mutually at right angles, and four sets of holding means, one in each quadrant formed by the panels. With this arrangement, at any time two quandrants may lie within the kiln, while two are outside. The kiln is divided in two internally by one of the panels, and two co-planar panels form the two wall sections which close the kiln.

Referring now to the drawings, an embodiment of the invention will be described.

FIG. 1 shows a kiln designed for the specific purpose of curing the ink of a silk-screen print made on garments such as tee-shirts. The kiln has an upper part 10 forming the kiln proper, and a base part 11 housing ancillary equipment.

Figure 2:
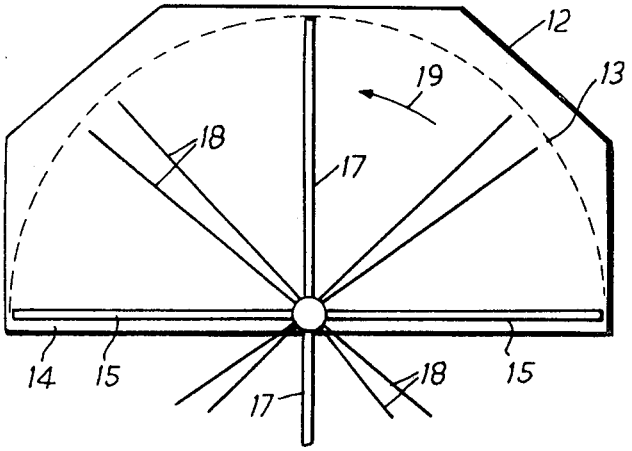
FIG. 2 shows (to a smaller scale) a section through the upper part of the kiln of FIG. 1.

The upper part has a polygonal housing 12 which includes a hemi-cylindrical space indicated by the dotted line 13 in FIG. 2. The housing 12 is heated insulated, but is open over its longest face 14.

That face 14 is closed by two wall sections formed by co-planar panels 15 which project radially from an axle post 16. The latter is supported for rotation about its vertical axis and this allows the panels 15 to sweep through the space defined by line 13. Two other co-planar panels 17 lie radially between panels 15, thus defining four quadrant spaces. Each space includes a set of article supports 18 formed of bent rod and fixed to the post 16. The combination of the panels and supports, rotatable in the direction of arrow 19 about the post, will be referred to as the "roundabout".

The panels 15, 17 are all provided around their free edges with sealing means 20, for example a bristle strip or an elastomeric strip, which ensure that when forming a closure wall they adequately seal with the static walls at the sides, top and bottom of the housing. The housing 12 has a vent 21 in its top. At the top of the post 16 is clamping means 22, and a ratchet actuating arm 23 which allows the roundabout to be rotated through 90° exactly and then stopped.

Figure 3:
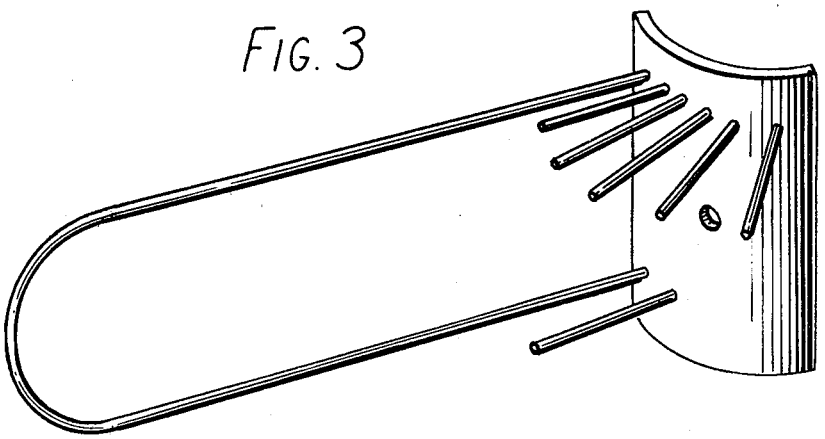
FIG. 3 shows an article holder designed to support garments.

The entire housing and roundabout are supported on the basepart 11. This has a control panel 25 in its front surface and two fan inlets 26 in its side. Within the base part 11 is a blower, an electric heater element, and ducting surfaces which direct heated air up into the housing 12. This heating means enables a temperature to be maintained in the kiln of up to 150° C. A removable garment support is shown in FIG. 3.

In operation, the articles, for example tee-shirts carrying a design in wet ink, are mounted to hang on the article supports 18 next to enter the kiln. After a predetermined curing time for the articles then in the kiln, the roundabout is rotated 90° to take the new articles into the kiln, and those articles in the diagonally opposite quadrant out of the kiln. The hot air in only one quadrant is thus released into the ambient atmosphere.

Each set of articles in one quadrant spends two dwell periods in the kiln. Meanwhile, the cured articles are being removed from one quadrant and fresh articles being stowed in the other, outside the kiln. This facility to both unload and load one quarter at a time leads to more economical use of operator time. The panels, at all times when the roundabout is not actually being rotated, seal off the kiln. Thus only through the exhaust vent 21 is heat lost, and this is both more economical and leads to easier working conditions.

It can be envisaged that the roundabout might have other than four divisions, e.g. three, or six. The housing must then be shaped accordingly so as to seal with the panel edges.

Of course, the article holders may take a different form, and may be made easily removable and interchangeable. For example, holders may be provided for curing printed circuit boards.

Moreover, other forms of heating than electrically heated air may be provided e.g. infra-red radiators inside the housing.

It will be understood that the above description of the present invention is susceptible to various modification, changes and adaptations.

What is claimed is:

1. A kiln of the type having a housing, heating means for heating the interior of the housing, and transfer means for carrying articles to be cured into and out of the housing whereby additional access to articles in the heated interior is unnecessary, said kiln housing and transfer means comprising:

a plurality of fixed wall portions defining the housing and an aperture therein, said wall portions being heat insulated;

axle means vertically positioned within said aperture and rotatably supported at its top and bottom by said wall portions;

at least three spaced wall panels joined to and extending radially from said axle means to form a roundabout means, said panels being arranged so as to be movable, upon rotation of the axle means, to positions wherein two of the panels cooperate to close off said aperture, said two panels being heat insulated;

sealing means provided on at least said two panels or said fixed wall portions to reduce heat loss through the aperture when it is closed by said two panels;

article holding means positioned between adjacent wall portions; and a lever and ratchet means for rotating the axle means to selectively position the article holding means and enclose a minimum of 180° of the roundabout means within the interior of the housing while closing the aperture by means of said two panels.

* * * * *